US005314159A

United States Patent [19]

Szarata

[11] Patent Number: 5,314,159

[45] Date of Patent: May 24, 1994

[54] HANGING SYSTEM FOR FRAMES OF PAINTINGS OR THE LIKE

[75] Inventor: Mathias Szarata, Bornheim-Brenig, Fed. Rep. of Germany

[73] Assignee: Hasenkamp Internationale Transporte GmbH & Co. KG, Cologne, Fed. Rep. of Germany

[21] Appl. No.: 955,368

[22] Filed: Oct. 19, 1992

[30] Foreign Application Priority Data

Oct. 19, 1991 [DE] Fed. Rep. of Germany ... 9113038[U]

[51] Int. Cl.[5] ..... A47G 1/24

[52] U.S. Cl. ..... 248/476; 206/806; 248/466

[58] Field of Search ..... 248/466, 475.1, 476, 248/489, 494, 495, 496; 40/606, 152.1; 220/1.5; 217/36; 206/806, 575

[56] References Cited

U.S. PATENT DOCUMENTS

| | | | |
|---|---|---|---|
| 932,581 | 8/1909 | Rosenthal | 217/36 |
| 1,213,032 | 1/1917 | Smith | 217/36 UX |
| 2,297,790 | 2/1942 | Miller . | |
| 3,769,730 | 11/1973 | Dole . | |
| 4,003,539 | 1/1977 | Gutner | 248/489 |
| 4,557,457 | 12/1985 | Cockfield | 40/152.1 X |
| 4,572,470 | 2/1986 | Siffert | 248/489 X |
| 4,718,554 | 1/1988 | Barbato . | |
| 4,892,193 | 1/1990 | Thomas . | |
| 4,967,993 | 11/1990 | Wilson | 206/806 X |

FOREIGN PATENT DOCUMENTS

| | | | |
|---|---|---|---|
| 226021 | 10/1908 | Fed. Rep. of Germany . | |
| 8330618 | 10/1983 | Fed. Rep. of Germany . | |
| 9112914 | 10/1991 | Fed. Rep. of Germany . | |
| 9115496 | 2/1992 | Fed. Rep. of Germany . | |
| WO8706111 | 4/1987 | PCT Int'l Appl. . | |
| 2131356 | 6/1984 | United Kingdom | 248/466 |

*Primary Examiner*—J. Franklin Foss

[57] ABSTRACT

A hanging system for framed paintings and other basically plate-like objects, has at least one hanging rail attached securely to a frame and a mounting rail which is detachably mountable to the hanging rail; wherein said hanging rail has at least one fastening point by which the mounting rail is detachably fastenable to the hanging rail. Preferably, at least one hanging rail is located in each corner of the frame and the fastening point is in the form of a threaded bore. The hanging system also includes a transport frame having lengthwise sides and crosswise sides which interconnect the lengthwise sides to which outwardly projecting ends of the hanging rails are attachable. Preferably, the transport frame has lengthwise sides with longitudinally extending openings, and crossbars which extend parallel to the crosswise sides and are mounted in the longitudinally extending openings so as to be adjustably guidable therein and fixable in a lockable manner.

27 Claims, 3 Drawing Sheets

HANGING SYSTEM FOR FRAMES OF PAINTINGS OR THE LIKE

BACKGROUND OF THE INVENTION

1. Field of the Invention

The invention relates to a hanging system for framed paintings or other basically plate-like objects.

While the teaching of this invention is explained below based on the preferred intended use for framed paintings, it is always to be kept in mind that the teaching of this invention is also suitable for all other basically plate-like objects, for example, for poster mountings, for other art objects, or the like, that require hanging.

2. Description of Related Art

Normally, with framed paintings, a hanging system is used that has hanging angles or hanging brackets securely fastened to the backside of the frame. With hanging angles the frame is hung on hooks on the wall or with hanging brackets the frame is hung on a cord leading down from a display rail. With pictures, that are frequently moved, be it that their hanging places are changed, or that they are hung in different places in a gallery, from time to time the necessity arises to move hanging angles and hanging brackets on the backside of the frame of the painting. If such frames are transported over considerable distances, for which they then have to be inserted in a transport frame, the hanging angles or hanging brackets are normally removed to be able to complete cover the frame all over in cushioning material.

The result of the above explained situation is that, often, in older and "widely traveled" framed paintings, their backsides have a dense hole pattern, so that there are hardly any more possibilities for attaching hanging brackets or hanging angles. A special problem is that major difficulties are often caused in the hanging of old, perhaps even somewhat brittle and possibly also very heavy frames of large paintings.

Another problem is the transportation of such paintings that are in frames. Transport frames, as already noted above, are used for this purpose. Transport frames are flat boxes made mostly of wood, in which the painting in the frame is placed in soft cushioning material, especially plastic foam. Then, the painting is tightly surrounded on all sides by cushioning material so as not to be damaged in transport by vibrations and impacts. To achieve sufficient protection, here, the cushioning material must be made very thick and tight. Especially on the bottom edge of the frame, on which the full weight of the painting acts, achieving adequate padding is extraordinarily problematic, so that, time and again, damages in transit are nothing out of the ordinary.

The cushioning of paintings in a frame for transporting has a further great drawback. Paintings in this category of art must be exposed, as much as possible, to constant climatic surrounding conditions. Therefore, they are carried in specially air-conditioned transport vehicles. But, the best air-conditioning fails if, because of the thick padding of the painting, the predetermined climate produced in the air-conditioned transport space cannot be effective on the painting itself. Thus, the problem is that a sufficient air exchange through the cushioning cannot be guaranteed.

SUMMARY OF THE INVENTION

The primary object of the present invention is to provide a suitable hanging system for framed paintings and other basically plate-like objects that solve the above addressed problems.

This object and others are achieved in that at least one hanging rail is attached securely to the frame, preferably at least in each corner of the frame, and that the hanging rail, itself, has at least one fastening point, preferably in the form of a threaded bore, by which a mounting rail can be fastened to the hanging rail.

According to the invention, a hanging rail that is permanently attached to the frame is achieved. This hanging rail remains on the frame. It, first, serves as base for attaching the hanging angle or hanging bracket to it for hanging the frame of painting. Moreover, it is used to attach a mounting rail, that can be attached to the hanging rail, for transporting or also for hanging. The mounting rail can carry the frame in a transport frame; but, it can also be used under special conditions for attaching the frame to the wall of an exhibition room or the like. The base permanently provided to the frame of the painting, by which the hanging rail is achieved, is essential.

For hanging a frame normally two hanging rails in the two upper corners of the frame, possibly in addition also another hanging rail centered on top, are sufficient. But, for universal use of this hanging system, it is advisable to place at least one hanging rail in each of the four corners of the frame.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
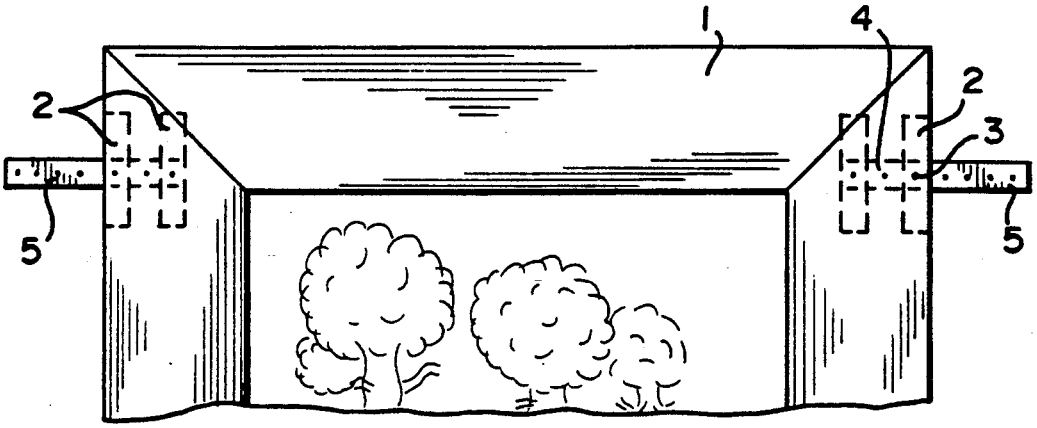
FIG. 1 shows a portion of the front of a framed painting.

To start with, it is essential for the hanging system according to the invention to have at least one hanging rail 2(FIGS. 2 and 3) firmly fastened to frame 1, as FIG. 1 shows. Hanging rail 2, itself, has at least one fastening point 3, by which a mounting rail 4 can be fastened to hanging rail 2. On a frame 1 as shown in FIG. 1, according to the preferred teaching, hanging rails 2 are firmly attached to the frame in each corner of frame 1.

In the embodiment represented in FIG. 1, hanging rails 2 are provided in pairs placed next to one another, for reasons explained further below. These hanging rails 2 remain on frame 1. On the one hand, the hanging rails 2 can be used for hanging frame 1, if the painting is to be exhibited somewhere with this frame 1, or on the other hand, if necessary, mounting rails 4 can be attached to them when frame 1 is to be transported somewhere with the painting mounted therein (so that it, thus, can still be regarded as "hung"). Basically, the mounting rails 4 can also be used if the framed painting is to be hung somewhere in a manner resistant to theft.

Figure 2:
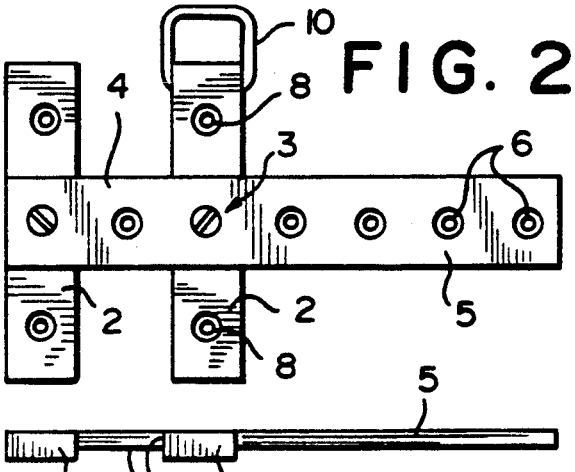
FIG. 2 shows an embodiment of a hanging rail with a mounting rail, as is used according to FIG. 1.
Figure 6:
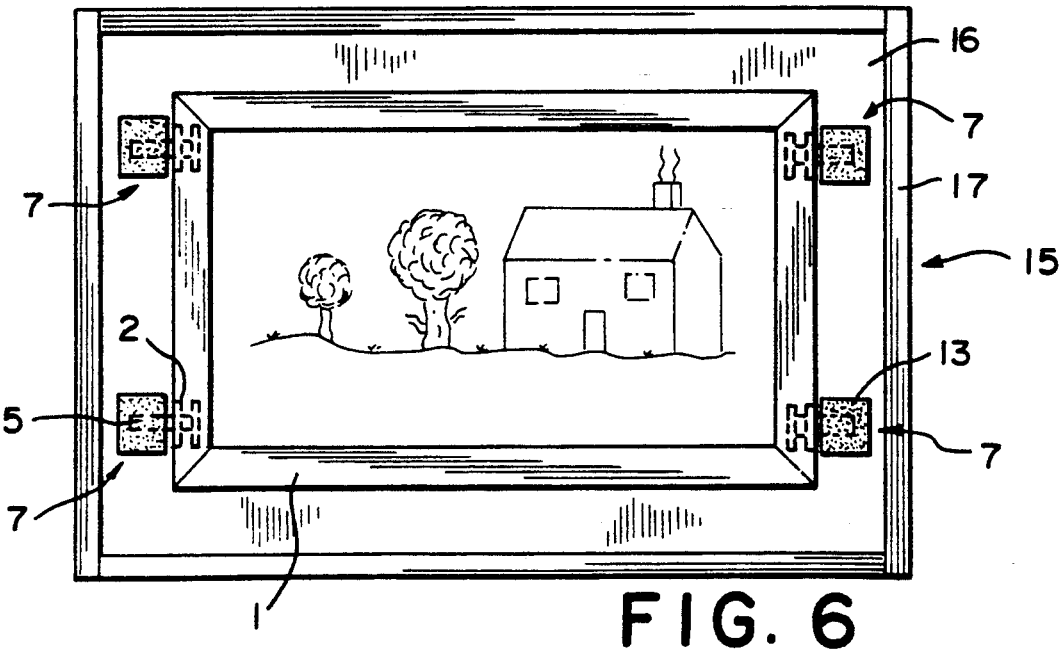
FIG. 6 shows a framed picture placed in a transport frame, with the cover of the transport frame removed.

As made clear, especially in FIGS. 1, 2 and 6, the length of the mounting rail 4 is designed so that the mounting rail 4, fastened to hanging rail 2, has a fastening section 5 that protrudes beyond the side edge of the frame 1. Instead of protruding sideways, as represented, mounting rail 4, of course, could also project downward or upward. In any case, in fastening section 5, mounting rail 4 is provided with at least one fastening point 6, by which it can be fastened to a frame carrier 7 (FIG. 6).

Frame carrier 7 can be a part of transport packaging, but is can also be a frame carrier 7 on a wall of an exhibition room. It is only essential that frame carrier 7 be fastened somewhere, and is used for fastening frame 1 by mounting rail 4 and hanging rail 2. More detailed explanations concerning the design of preferred embodiments of frame carriers 7 are set forth below.

Mounting rail 4, in the embodiments represented in the drawing, is connected with hanging rail 2, at fastening points 3, that are made as threaded bores in which corresponding fastening screws that are made as flat head screws are receivable. In this connection, it is essential that mounting rail 4 is, thus, detachably connected with hanging rail 2. If mounting rail 4 is no longer needed, such as, for example, the transport is completed, it can be simply unscrewed from frame 1, without open holes resulting in this way on frame 1 itself. This is because the hanging rail 2 is used as the fastening point for the mounting rail 4, and the hanging rail 2 remains permanently on frame 1.

In principle, there are, of course, a lot of possibilities for fastening the mounting rail 4 onto the hanging rail 2. Another advantageous embodiment, but not represented here, could also be configured so that mounting rail 4 is fastened on to hanging rail 2 by a hinged joint. Mounting rail 4 and hanging rail 2 would then be permanently connected but, when not in use, the mounting rail 4 can be retracted so that it lies on the backside of frame 1 and no longer protrudes sideways.

FIG. 2 makes clear that, according to the preferred teaching, two countersunk through bores 8 are provided for attaching of each hanging rail 2 to the frame 1 by fastening screws. There is probably no need for further explanation. Here, too, there are of course many different possibilities to fasten hanging rail 2 on frame 1. Last, but not least, hanging rail 2 can also be fastened to frame 1 by permanent bonding.

Figure 3:
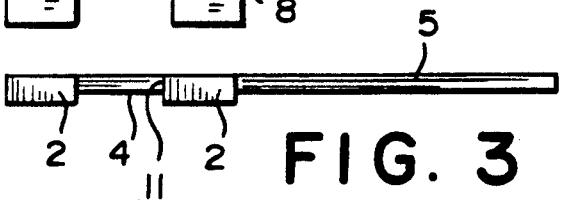
FIG. 3 is a plan view of the embodiment of FIG. 2.
Figure 5:
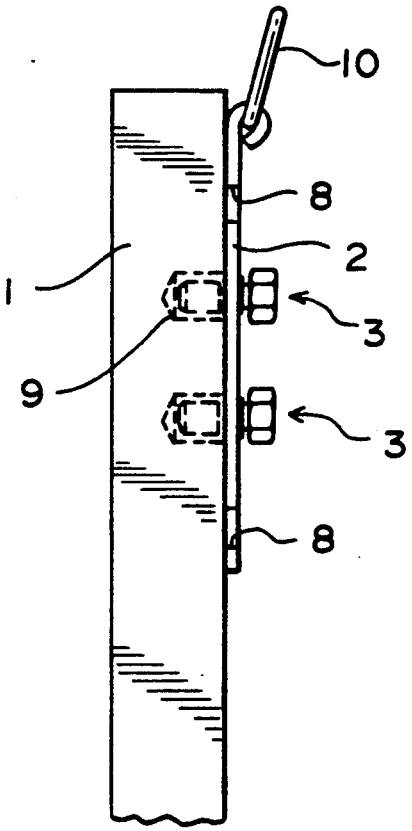
FIG. 5 shows another embodiment of a hanging rail on a top portion of a frame.

As already mentioned the embodiment of hanging rail 2 and mounting rail 4 represented in FIGS. 2 and 3 has fastening points 3 on hanging rail 2 that are made as threaded bores in hanging rail 2, i.e., a thread is tapped into the material of hanging rail 2 to that extent. However, with hanging rails 2 of very thin material thicknesses, it is not possible to achieve a thread of sufficient length or tensile strength; but, with certain frames 1, it is not desirable to apply the hanging rail 2 so strongly to the backside of frame 1, so that a hanging rail 2 with a thickness of, e.g., 6 mm, as shown in FIG. 3, would, then, not be acceptable. For such circumstances, FIG. 5 shows another embodiment, which utilizes a fastening point 3 on hanging rail 2 which is made as through bore with threaded piece 9 fastened securely to it. With a sink bore on frame 1, a threaded piece 9 (that has to be fastened only once) can be sunk in the material of frame 1 so that, toward the rear, only the material thickness of hanging rail 2, for example, here 2 mm, is applied. Nevertheless, mounting rail 4 can be fastened with fastening screws, that are indicated here, to hanging rail 2, without burdening frame 1 in any way, since threaded piece 9 is securely fastened on the hanging rail 2 to the respective through bore, for example, piece 9 is fastened in the bore via a press fit or is soldered thereto. A force transmission from the fastening screws directly into frame 1, thus, does not take place.

Further examples for possible connections to fastening points 3 include latching connections, bayonet connections. Also, simple plug-in connections with corresponding shaping of hanging rail 2 and/or mounting rail 4 with a plug receptacle can be presented as well. Of course connections that are based on simple bores and threaded bores are especially suitable from a production aspect.

The embodiment according to FIG. 5 also shows a characteristic feature in that, here, two fastening points 3 are placed side by side, or by their mode of action placed one on top of the other, with a hanging rail 2 placed on the upper edge of frame 1 to increase the carrying capacity of the fastening.

Figure 4:
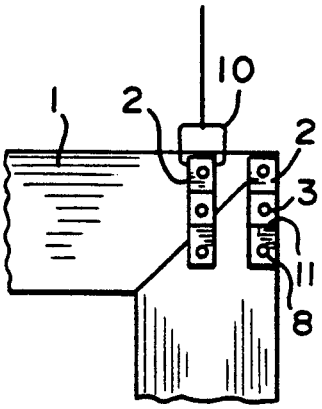
FIG. 4 shows a corner portion of a frame with a hanging system and hanging handle.

FIG. 4 makes clear, that hanging rail 2, in an especially suitable way, should be fastened to the upper edge of frame 1. Of course, mounting at distance from the upper edge of frame 1, as represented in FIG. 1, is also possible, and has the advantage that the hanging loop 10, as represented in FIG. 4, would be hidden by frame 1. In FIG. 4 hanging loop 10 appears on hanging rail 2 above frame 1, a hanging cord is indicated there. Hanging loop 10 in the represented embodiment is connected foldably or is hinged with hanging rail 2. Here, it is made as a C-shaped handle that has its free ends swivelably hooked into receptacles formed by curling of the end of the hanging rail 2. Thus, this hanging loop, by the effect of its own elasticity, can be detached from hanging rail 2 or again fastened to it. A multiplicity of other embodiments are likewise conceivable.

Now, the embodiments represented in FIGS. 1 to 4 further make clear, that here, according to preferred teaching, hanging rails 2 are placed in pairs next to one another (or on top of one another) and the mounting rail 4 can be fastened together to both hanging rails 2. FIGS. 1 and 2 make clear that, with two hanging rails 2 placed in pairs next to one another, the mounting rail 4 can, then, be fastened to both hanging rails 2, by which a two point fastening is obtained, i.e., it is no longer able to swing horizontally relative to hanging rail 2. Beyond the distribution to several fastening points 3 or hanging rails 2, this manner of fixing is of special importance, above all, for the hanging of frame 1 for transport purposes, as represented in FIG. 6. Of course, a similar effect can also be achieved by two fastening points 3 on hanging rail 2, as represented in FIG. 5. Then, mounting rail 4 also can no longer easily be swung horizontally relative to hanging rail 2, and thus, both elements are then connected rigidly with one another, which is a fastening method to be aimed for.

In the represented embodiments, mounting rail 4 extends crosswise to hanging rail 2 or hanging rails 2, which is especially suitable from a production engineering standpoint and is especially useful as a fastening method. The embodiment that is represented in FIGS. 2 and 3, now, shows that also a special shaping of hanging rails 2 was selected. Namely, it is provided that the hanging rails 2 each have a positive locking element. This positive locking element 11 is made as a crosswise groove with a width that matches the width of mounting rail 4. When mounting rail 4 is inserted in this groove, which serves as the positive locking element 11, and is then fastened by the fastening screw, a rigid angular connection to hanging rail 2 is achieved by the meshing of the mounting rail 4 and positive locking element 11 so that they physically are interlocked with each other. Of course, such a connection by positive locking elements can also be achieved with other techniques, for example, by lugs, cams, hooks, or the like, which can also be provided on mounting rail 4 instead of or in addition to hanging rail 2.

It is especially suitable that hanging rail 2 and/or mounting rail 4 are made from metal, especially from galvanized steel strip. High grade steel is also suitable, possibly also plastic, and then for reasons of sturdiness reinforced plastic, for example, plastic reinforced with carbon fibers or glass fibers, is suitable. But, plastic parts can probably be considered only for lighter frames 1; heavy baroque frames need a metallic construction of the parts of the hanging system.

For production engineering, a construction as cast part is advisable for the possibly somewhat more complex part "hanging rail", while mounting rail 4, can be made into a rail with holes from steel strip.

Figure 7:
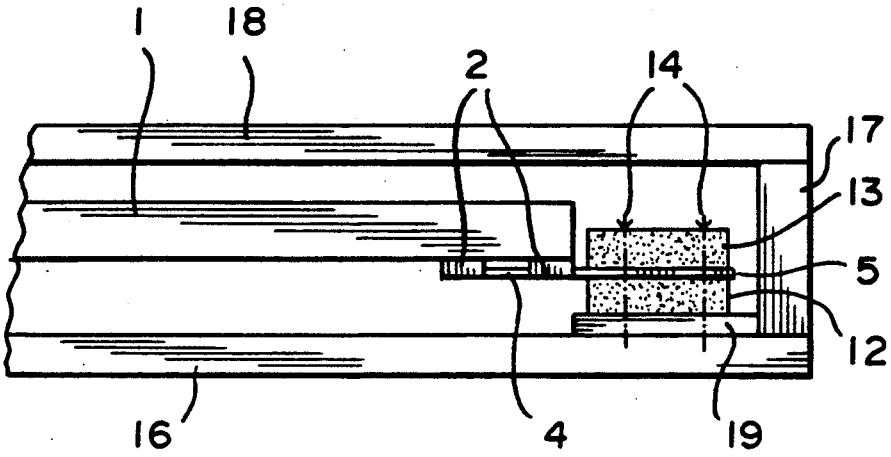
FIG. 7 shows a portion of the transport frame of FIG. 6 with the top removed to reveal the inside thereof.

FIGS. 6 and 7, now, also make clear the importance of the hanging system according to the invention from the transportation standpoint. That is, frame carrier 7 comprises a support buffer 12 for damping vibrations and impacts relative to mounting rail 4 and mounting rail 4 can be braced with the support buffer 12, preferably, by an intermediate layer of another damping buffer 13. Both buffers 12, 13 are especially clearly recognizable in FIG. 7, two fastening and tightening screws 14 are also indicated there with which the buffers 12 and 13 are braced on frame carrier 7 sandwiching the mounting rail 4 therebetween. Then, the openings in mounting rail 4 should be made, as much as possible, large enough so as to avoid direct contact between the mounting rail 4 and the fastening and tightening screws 14. This can be realized, for example, by a larger diameter of the bores in mounting rail 4 and a corresponding connecting-piece-like supporting configuration of support buffers 12 in the middle area so that the damping material is effective laterally even between fastening and tightening screws 14 and mounting rail 4. Then, a type of swinging-damping support is achieved for frame 1 at each corner, as represented in FIG. 5, without any cushioning material having to be used around frame 1.

FIG. 6 shows the transportation configuration wherein several frame carriers 7 are parts of a transport frame 15, and preferably, are securely fastened to wall 16 of transport frame 15. Four frame carriers 7, one at each corner of frame 1, are shown, and on larger frames 1, auxiliary supports could also be placed between them. Mounting rails 4 are hidden respectively by buffers 13, fastening and tightening screws are indicated. Frame carriers 7 are mounted on the wall 16 of transport frame 15, which is shown especially well in FIG. 7.

Frame 1, thus, has sufficient distance not only from wall 16, but also from walls 17 and cover 18 of transport frame 15. Because of the floating mounting of frame 1, via frame carriers 7 and mounting rail 4, it is possible to dispense completely or at least essentially with cushioning material between frame 1 and transport frame 15. Vibrations and impacts are especially kept away, for the most part, from frame 1, if frame carriers 7, as represented, are provided with support buffers 12 and buffers 13, i.e., the mounting of mounting rail 4 takes place in the manner of a vibration damper. Since it is possible to dispense with cushioning material in transport frame 15 in most cases, the climate in a transportation area reaches the inside of transport frame 15 and directly the painting contained in it, so that there are no possibilities for transportation damages in most cases.

Figure 8:
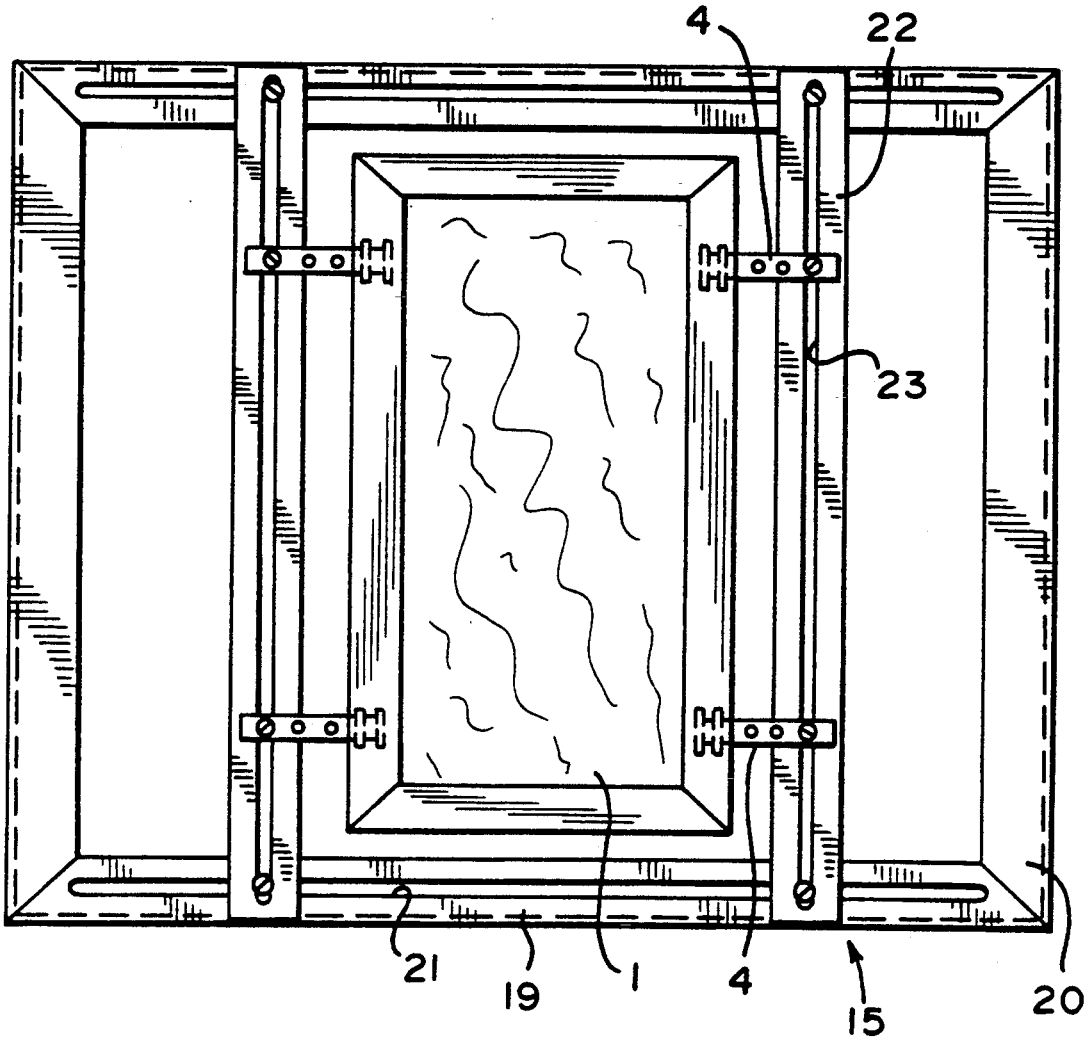
FIG. 8 shows a view of a transport frame in another embodiment.

FIG. 8 shows a view of another, especially preferred embodiment of a transport frame 15 for a hanging system of the type under discussion. While the transport frame represented in FIGS. 6 and 7 is box-shaped and permits attachment of frame carriers 7 to wall 16, the transport frame represented in FIG. 8 is a true circumferential frame consisting of lengthwise sides 19 that are connected by crosswise sides 20. According to the invention, the lengthwise sides 19 are equipped with longitudinally adjustable guideways 21 in which crossbars 22, that are parallel to the crosswise sides 20, are guided in a lockable manner. Frame carriers 7, thus, either are formed by the crossbars 22 or are placed on them.

In the embodiment represented in FIG. 8, it is also essential that the crossbars 22, themselves, are provided with longitudinally adjustable guideways 23 which run parallel to the crosswise sides 20 of the transport frame 15. Thus, mounting rails 4 can be fastened, in various positions, to the crossbars 22 via the longitudinally adjustable guideways 23.

Transport frame 15, according to the FIG. 8 embodiment of the invention, is suitable for transporting different sizes of framed paintings since it is widely adjustable. Mounting rails 4 of framed painting 1 can easily be fastened with threaded screws and wing nuts to crossbars 22, similar to embodiments 6 and 7 for fastening and tightening screws 14. But, the height of the framed paintings 1 and the width of crossbars 22 in transport frame 15 can be adjusted. That has the big advantage that a single transport frame 15 of preset outside dimensions can be used for all commonly occurring frame sizes or, if necessary, using two or three standard transport frames 15 of different outside dimensions. Thus, a standardization of the outside dimensions of the transport frame 15, which is advantageous from a transportation standpoint, is achieved largely independent of the dimensions of respective framed painting 1 to be actually transported.

It is especially advantageous to produce frame 15 from metal L-shaped straps, especially light-metal L-shaped straps, e.g., aluminum. For crossbars 22, correspondingly thick flat material, optionally also embossed, can be used.

Longitudinally adjustable guideways 21, 23 do not have to be designed as longitudinal slots, as represented. It is also possible to provide corresponding tracks of punched holes or the like.

The hanging system according to the invention for framed paintings and other basically plate-like objects, on the one hand, is altogether suitable with respect to usual hanging for the purpose of exhibition, and on the other hand, extraordinarily suitable for transportation purposes, solving practically all problems of known hanging systems.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. Hanging system for framed paintings and other basically plate-like objects, comprising at least one hanging rail attached securely to a frame and a detachable mounting rail; wherein said hanging rail has at least one fastening point by which the mounting rail is detachably fastenable to the hanging rail in a rigid manner by a nondestructively removable fastening device.

2. Hanging system according to claim 1, wherein the mounting rail has a length that is dimensioned so that a fastening part of the mounting rail, when fastened to the hanging rail, protrudes beyond an edge of the frame, and wherein the fastening section of the mounting rail is provided with at least one fastening point for connection to a frame carrier.

3. Hanging system according to claim 2, wherein each hanging rail has at least two bores for attachment thereof to the frame by fastening screws.

4. Hanging system according to claim 1, wherein the material thickness of hanging rail is too small to contain an adequate screw thread and wherein the fastening point on the hanging rail is comprises a throughbore with a threaded connecting piece securely fastened to it.

5. Hanging system according to claim 1, wherein the hanging rail is provided with at least two fastening points which are disposed one on top of the other.

6. Hanging system according to claim 5, wherein a hanging loop is detachably fastened to the hanging rail in a hinged manner.

7. Hanging system for framed paintings and other basically plate-like objects, comprising at least one hanging rail attached securely to a frame and a detachable mounting rail; wherein said hanging rail has at least one fastening point by which the mounting rail is detachably fastenable to the hanging rail; and wherein a pair of hanging rails is placed next to one another on the frame; and the mounting rail is fastened to both hanging rails of the pair; and wherein at least one fastening point for a frame support is provided on a cantilevered portion of the mounting rail.

8. Hanging system according to claim 7, wherein the mounting rail is mounted crosswise to the pair of hanging rails.

9. Hanging system according to claim 1, wherein the hanging rail and the mounting rail are constructed to physically interlock with each other.

10. Hanging system according to claim 9, wherein the hanging rail has positive locking element comprised of a groove of a width matched to the width of the mounting rail and in which the mounting rail is insertable to produce said physically interlock therebetween.

11. Hanging system according to claim 10, wherein at least one of the hanging rail and the mounting rail are made of a material selected from the group consisting of a high-grade steel, a galvanized steel, and a reinforced plastic.

12. Hanging system according to claim 1, wherein the mounting rail is made of a strip with holes.

13. Hanging system according to claim 2, wherein the frame carrier comprises a support buffer means for damping the transmission of vibrations and impacts from the frame carrier to the mounting rail; and wherein fastening means are provided for bracing the mounting rail with respect to the support buffer.

14. Hanging system according to claim 13, wherein the fastening means braces the mounting rail with respect to the support buffer via an intermediate layer formed by a second damping buffer.

15. Hanging system according to claim 2, wherein a plurality of frame carriers are parts of a transport frame.

16. Hanging system according to claim 15, wherein said plurality of frame carriers are securely fastened to a bottom wall of the transport frame.

17. Hanging system for framed paintings and other basically plate-like objects, comprising at least one hanging rail attached securely to a frame and a detachable mounting rail; wherein said hanging rail has at least one fastening point by which the mounting rail is detachably fastenable to the hanging rail; wherein the mounting rail has a length that is dimensioned so that a fastening part of the mounting rail, when fastened to the hanging rail, protrudes beyond an edge of the frame, and wherein the fastening section of the mounting rail is provided with at least one fastening point for connection to a frame carrier; further comprising a transport frame having lengthwise sides and crosswise sides which interconnect the lengthwise sides; wherein the lengthwise sides are provided with longitudinally extending openings; and wherein crossbars extend parallel to the crosswise sides and are mounted in the longitudinally extending openings so as to be adjustably guidable therein and fixable in a lockable manner.

18. Hanging system according to claim 17, wherein the frame carriers are formed by the crossbars.

19. Hanging system according to claim 17, wherein the frame carriers are placed on the crossbars.

20. Hanging system according to claim 17, wherein the crossbars, themselves, are provided with longitudinally adjustable guideways running parallel to the crosswise sides; and wherein the mounting rails are fastenable in the longitudinally adjustable guideways in various positions.

21. Hanging system according to claim 17, wherein the transport frame is formed of L-shaped metal straps.

22. Hanging system according to claim 1, wherein at least one said hanging rail is located in proximity to each corner area of the frame and said at least one fastening point is in the form of a threaded bore.

23. Hanging system for framed paintings and other basically plate-like objects, comprising at least one hanging rail attached securely to a frame and a mounting rail detachably and rigidly coupled with the hanging rail at a pair of adjacent fastening points; wherein said mounting rail has a portion that is cantilevered outwardly beyond the frame from said fastening points; and wherein at least one fastening point for a frame support is provided on the cantilevered portion of the mounting rail.

24. Hanging system according to claim 23, wherein each of said pair of adjacent fastening points is formed by a threaded fastening piece secured in a bore in the frame and a threaded fastening screw extending through the hanging rail into the threaded fastening piece in the frame.

25. Hanging system according to claim 23, wherein the hanging rail and the mounting rail are constructed to physically interlock with each other.

26. Hanging system for framed paintings and other basically plate-like objects, comprising at least one hanging rail attached securely to a frame and a detachable mounting rail; wherein said hanging rail has at least one fastening point by which the mounting rail is detachably fastenable to the hanging rail; and wherein the hanging rail and the mounting rail are constructed to physically interlock with each other in a manner precluding relative rotation therebetween.

27. Hanging system according to claim 26, wherein the construction by which the hanging rail physically interlocks with the mounting rail comprises a positive locking element comprised of a groove in the hanging rail of a width matched to the width of the mounting rail and in which the mounting rail is insertable.

* * * * *